US007306859B2

(12) United States Patent
Wortman et al.

(10) Patent No.: US 7,306,859 B2
(45) Date of Patent: Dec. 11, 2007

(54) THERMAL BARRIER COATING SYSTEM AND PROCESS THEREFOR

(75) Inventors: David John Wortman, Hamilton, OH (US); Jonathan Paul Blank, Mason, OH (US); Sean Robert Keith, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 10/905,976

(22) Filed: Jan. 28, 2005

(65) Prior Publication Data

US 2007/0172678 A1 Jul. 26, 2007

(51) Int. Cl.
*B32B 15/00* (2006.01)
*F03B 3/12* (2006.01)

(52) U.S. Cl. ..... 428/701; 416/241 B; 428/702

(58) Field of Classification Search ..... 428/701, 428/702; 416/241 B
See application file for complete search history.

(56) References Cited

U.S. PATENT DOCUMENTS 5,660,885 A 8/1997 Hasz et al. ..... 427/374.5
5,683,825 A * 11/1997 Bruce et al. ..... 428/698
5,914,189 A 6/1999 Hasz et al. ..... 428/335
6,057,047 A 5/2000 Maloney ..... 428/623
6,060,177 A 5/2000 Bornstein et al. ..... 428/623
6,261,643 B1 * 7/2001 Hasz et al. ..... 427/419.1
6,284,323 B1 * 9/2001 Maloney ..... 427/419.2
6,296,447 B1 10/2001 Rigney et al.
6,296,945 B1 10/2001 Subramanian
6,306,517 B1 10/2001 Gray et al. ..... 428/469
6,382,920 B1 * 5/2002 Dopper ..... 416/241 R
2002/0094448 A1 7/2002 Rigney et al.

* cited by examiner

*Primary Examiner*—Jennifer McNeil
*Assistant Examiner*—Jason Savage
(74) *Attorney, Agent, or Firm*—David L. Narciso; Gary M. Hartman; Domenica N. S. Hartman

(57) ABSTRACT

A coating process and TBC system suitable for protecting the surface of a component subjected to a hostile thermal environment. The TBC system has a first layer with a columnar microstructure, and a second layer on the first layer and with a microstructure characterized by irregular flattened grains. According to one aspect, the first layer is present and the second layer is not present on a first surface portion of the component, and the first and second layers are both present on a second surface portion of the component. According to another aspect, the first and second layers contain the same base ceramic compound.

15 Claims, 2 Drawing Sheets

THERMAL BARRIER COATING SYSTEM AND PROCESS THEREFOR

BACKGROUND OF THE INVENTION

The present invention generally relates to thermal barrier coating systems for components exposed to high temperatures, such as airfoil components of gas turbine engines. More particularly, this invention is directed to a thermal barrier coating system and process for selectively depositing multiple ceramic layers on different surface regions of a component to reduce surface temperatures and temperature gradients within the component.

Components within the hot gas path of a gas turbine engine are often protected by a thermal barrier coating (TBC) system. TBC systems include a thermal-insulating topcoat, also referred to as the thermal barrier coating or TBC. Ceramic materials are used as TBC materials because of their high temperature capability and low thermal conductivity. The most common TBC material is zirconia ($ZrO_2$) partially or fully stabilized by yttria ($Y_2O_3$), magnesia (MgO) or another alkaline-earth metal oxide, ceria ($CeO_2$) or another rare-earth metal oxide, or mixtures of these oxides. Binary yttria-stabilized zirconia (YSZ) has particularly found wide use as the TBC material on gas turbine engine components because of its low thermal conductivity, high temperature capability including desirable thermal cycle fatigue properties, and relative ease of deposition by thermal spraying (e.g., air plasma spraying (APS) and high-velocity oxygen flame (HVOF) spraying) and physical vapor deposition (PVD) techniques such as electron beam physical vapor deposition (EBPVD).

To be effective, TBC's must remain adherent through many heating and cooling cycles. This requirement is particularly demanding due to the different coefficients of thermal expansion between ceramic materials and the superalloys typically used to form turbine engine components. As is known in the art, the spallation resistance of a TBC can be significantly improved with the use of an environmentally-protective metallic bond coat. Bond coat materials widely used in TBC systems include overlay coatings such as MCrAlX (where M is iron, cobalt and/or nickel, and X is yttrium or another rare earth or reactive element such as hafnium, zirconium, etc.), and diffusion coatings such as diffusion aluminides. When subjected to an oxidizing environment, these aluminum-rich bond coats develop an aluminum oxide (alumina) scale that is advantageously capable of chemically bonding a ceramic TBC to the bond coat and the underlying substrate.

Spallation resistance is also influenced by the TBC microstructure, with greater spallation resistance generally being achieved with microstructures that exhibit enhanced strain tolerance as a result of the presence of porosity, vertical microcracks, and/or segmentation. As used here, the term "segmentation" refers to a TBC with columnar grains oriented perpendicular to the surface of the component, such as that achieved with PVD processes such as EBPVD. The term "vertical microcracks" refers to fine cracks that are intentionally developed in thermal sprayed TBC's, whose microstructures otherwise generally consist of "splats" of irregular flat (noncolumnar) grains formed by solidification of molten particles of the TBC material. Plasma-sprayed TBC's with microcracks are discussed in U.S. Pat. Nos. 5,073,433, 5,520,516, 5,830,586, 5,897,921, 5,989,343 and 6,047,539. As is known in the art, ceramic TBC's having columnar grains and vertical microcracks are more readily able to expand with the underlying substrate without causing damaging stresses that lead to spallation.

The demand for higher temperatures to improve efficiency and reduce emissions puts additional demands on gas turbine engine components within the hot gas path. For example, the blade tips and inner platforms of high pressure turbine (HPT) blades and vanes are subjected to significantly higher temperatures within engines equipped with combustors having relative flat profiles to reduce emissions. Several methods are available for effectively cooling the airfoil and tip of a turbine blade, such as with bleed air that flows through internal passages within the blade and exits cooling holes on the surface of the airfoil and/or blade tip. Attempts to air cool blade platforms are complicated by the desire to avoid internal and surface features that could increase stress concentrations which, in combination with thermal gradients typically within platforms, can lead to cracking. Additionally, there can be regions of a platform that have low back flow margin. Though blade platforms generally see lower temperatures than blade tips, the thermal gradient within a platform can result in platform cracking if the airfoil is effectively cooled but the platform is not.

In view of the above, it would be desirable if a relatively thick TBC could be deposited on blade platforms to provide additional thermal protection and reduce the thermal gradient through the platform thickness. The process most often used to deposit TBC on air-cooled turbine blades is the above-noted EBPVD technique due to its ability to apply a thin, uniform coating without plugging the small cooling holes in the airfoil surface. However, TBC thicknesses capable of adequately reducing the surface temperature of a platform risk plugging the airfoil cooling holes. While the relative amount of TBC deposited on the platform can be increased by tilting the blade relative to the vapor source, the limitations of existing EBPVD equipment are such that a sufficiently thick TBC cannot be deposited on the platform without also depositing an excessively thick TBC on the airfoil. Another problem is that the erosion resistance of EBPVD TBC decreases to some degree if the surface being coated is other than parallel to the surface of the vapor source. As such, tilting a blade to increase the relative amount of TBC deposited on the platform can unacceptably reduce the erosion resistance of the TBC on the airfoil. Finally, the deposition rate on an inclined surface is relatively lower, thus increasing the time and cost of the deposition process.

BRIEF SUMMARY OF THE INVENTION

The present invention provides a coating process and a TBC system suitable for protecting surfaces of a component subjected to a hostile thermal environment, notable examples of which are airfoil components of gas turbine engines. The TBC system is selectively deposited as multiple ceramic layers on different surface regions of the component in a manner that reduces temperatures on the component surfaces, as well as reduces detrimental temperature gradients within the component.

The TBC system has a first ceramic layer with a columnar microstructure, and a second ceramic layer on the first ceramic layer with a microstructure characterized by irregular flattened grains. According to one aspect of the invention, the TBC system is deposited on first and second surface portions of a component, the first ceramic layer is present and the second ceramic layer is not present on the first surface portion of the component, and the first and second ceramic layers are both present on the second portion of the component. According to another aspect of the invention, the first and second ceramic layers are formed of ceramic materials having the same base ceramic compound, i.e., the predominant constituent to which stabilizers and other modifiers are added.

A significant advantage of this invention is that, because of the selective deposition of the second ceramic layer, the TBC system can be deposited whose thickness is tailored for different surface regions of a component, without resulting in excessive TBC thickness on surface regions where excess TBC would be detrimental. For example, the first layer of TBC can be deposited on both the airfoil and platform portions of an air-cooled blade, after which the second layer of TBC is selectively deposited on only the platform portion of the blade. In this manner, a relatively thick TBC can be deposited on the blade platform to provide additional thermal protection while avoiding excess TBC that would block the cooling holes of the airfoil.

Other objects and advantages of this invention will be better appreciated from the following detailed description.

DETAILED DESCRIPTION OF THE INVENTION

Figure 1:
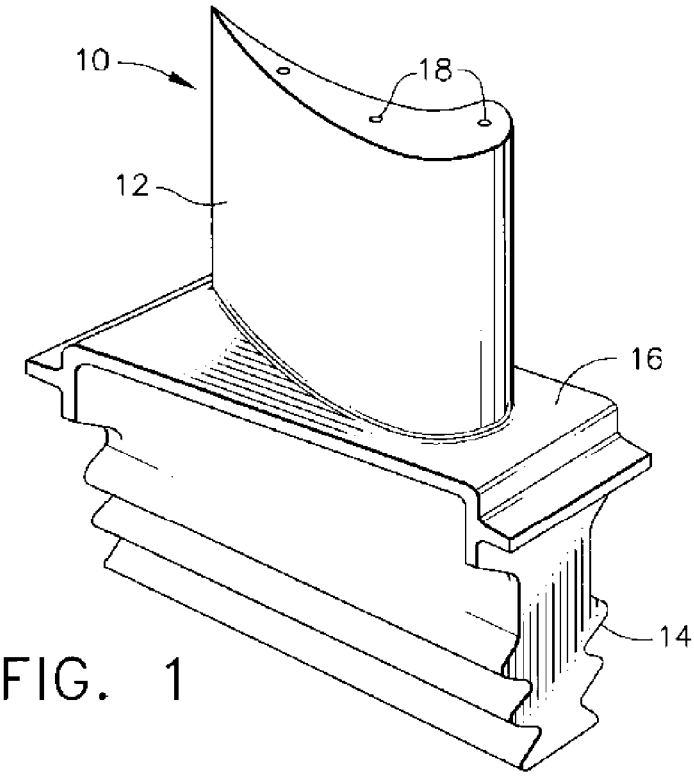
FIG. 1 is a perspective view of a high pressure turbine blade.

The present invention is generally applicable to components subjected to high temperatures, and particularly to components such as the high pressure turbine (HPT) blades and vanes of gas turbine engines. An example of an HPT blade 10 is shown in FIG. 1. The blade 10 has an airfoil 12, a dovetail 14 by which the blade 10 is anchored to a turbine disk (not shown), and a platform 16 therebetween. During operation of the gas turbine engine, the airfoil 12 and platform 16 are directly exposed to hot combustion gases. Significant cooling of the airfoil 12 is achieved by flowing bleed air through internal passages (not shown) within the blade 10. The bleed air exits the airfoil 12 through cooling holes 18 to transfer heat from the blade 10. While the advantages of this invention will be described with reference to components of a gas turbine engine, such as the high pressure turbine blade 10 shown in FIG. 1, the teachings of this invention are generally applicable to other components on which a TBC may be used to protect the component from a high temperature environment.

Figure 2:
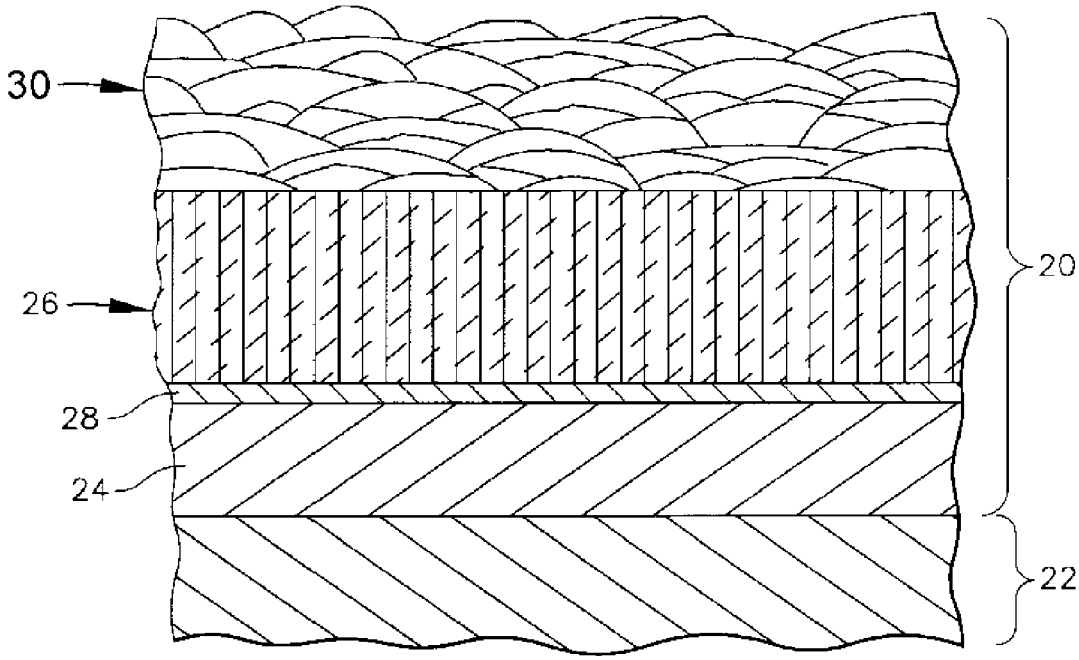
FIG. 2 is a cross-sectional representation of a surface region of the blade platform of FIG. 1, wherein a multilayer TBC system has been deposited on the platform in accordance with an embodiment of this invention.

FIG. 2 schematically represents a surface region 22 of the blade platform 16, on whose outer (external) surface a thermal barrier coating (TBC) system 20 has been deposited in accordance with an embodiment of the present invention. The TBC system 20 (not to scale) is shown as including a bond coat 24 on the surface region 22, which is preferably formed of a superalloy or another high temperature material. The bond coat 24 is preferably an aluminum-rich composition of a type typically used with TBC systems for gas turbine engine components, such as a platinum aluminide (PtAl) diffusion coating, an aluminide diffusion coating, a nickel aluminide (NiAl) diffusion or overlay coating, or an MCrAlX overlay coating. Aluminum-rich bond coats of this type develop an aluminum oxide (alumina) scale 28, which is thermally grown by oxidation of the bond coat 24.

FIG. 2 shows a TBC overlying the bond coat 24. The TBC comprises a ceramic columnar layer 26 on and contacting the alumina scale 28, and a ceramic noncolumnar layer 30 on and contacting the columnar layer 26. The layer 26 has a columnar microstructure as a result of being deposited by, for example, a PVD technique such as EBPVD, while the layer 30 has a noncolumnar microstructure as a result of being deposited by, for example, a thermal spray technique such as plasma spraying (air, vacuum, and low pressure) or high velocity oxy-fuel (HVOF) spraying. As known in the art, PVD is a line-of-sight film deposition technique that entails heating a material (often in a vacuum to prevent oxidation) to a temperature at which the material vaporizes and then condenses atom-by-atom on a cooler substrate. The resulting columnar microstructure enables the columnar layer 26 to expand and contract without causing damaging stresses that lead to spallation. In contrast, thermal spraying techniques involve propelling melted or at least heat-softened particles of a heat fusible material (e.g., metal, ceramic) against a surface, where the molten "splats" are quenched and bond to the surface to produce a coating whose microstructure is characterized by irregular flattened grains and a degree of inhomogeneity and porosity.

The columnar and noncolumnar layers 26 and 30 are both preferably zirconia-based materials containing at least one stabilizer, such as yttria, magnesia, or another alkaline-earth metal oxide, ceria or another rare-earth metal oxide, or mixtures of these oxides. It is also within the scope of this invention that other ceramic materials could be used. According to one aspect of the invention, the columnar and noncolumnar layers 26 and 30 can have the very same composition, including the same base compound (e.g., zirconia) and the same amount or amounts of the same stabilizer or stabilizers. In the preferred embodiment, the TBC material is yttria-stabilized zirconia (YSZ) and has an yttria content of about 7% to about 8%.

As evident from FIG. 2, the noncolumnar layer 30 is deposited directly on the columnar layer 26 on the platform 16. Because the thermal spray process can be performed to selectively deposit the noncolumnar layer 30 on certain surface regions of the blade 10 (e.g., the platform 16) while avoiding deposition on other surface regions of the blade 10 (e.g., the airfoil 12), the noncolumnar layer 30 can be selectively deposited on the platform 16 without increasing the total thickness of the TBC on the airfoil 12 and without blocking the airfoil cooling holes 18. Therefore, the present invention enables thick TBC to be deposited on localized surface areas of a component without affecting the thickness of other areas on which a thick TBC is not needed and/or is unacceptable. Reliance on a thermal spray technique to build up a thick TBC on the platform 16, such as 5 mils (about 125 micrometers) or more, also avoids the extended coating time that would be required to deposit an equivalent TBC thickness using a PVD process. In this manner, the thickness of the TBC on the platform 16 can be selectively increased in a cost effective manner to achieve the thermal protection required by the platform 16. An additional benefit is that the thermal-sprayed noncolumnar coating 30 provides the TBC on the platform 16 with an erosion resistant noncolumnar surface without detrimentally affecting the erosion resistance of the EBPVD-deposited columnar layer 26 on the airfoil 12.

In one example in which a TBC system 20 within the scope of this invention was deposited on a HPT blade (e.g., blade 10), a PtAl diffusion aluminide bond coat 24 was formed using conventional processes to have a thickness of about two mils (about 50 micrometers). Thereafter, the blade underwent EBPVD coating that resulted in the deposition of a columnar layer 26 with a thickness of about 4 to about 6 mils (about 100 to 150 micrometers) on the platform 16 and a thickness of about 6 to about 8 mils (about 150 to 200 micrometers) on the airfoil 12. The difference in coating thickness was attributable to the inherently difference orientations of the airfoil 12 and platform 16 to the vapor source. Finally, and without any surface preparation of the columnar layer 26, a noncolumnar layer 30 was deposited on only the platform 16 by plasma spraying to a thickness is about 5 mils (about 125 micrometers). As such, though the thickness of the columnar layer 26 was significantly greater on the airfoil 12 than on the platform 16, the combined thickness of the columnar and noncolumnar layers 26 and 30 on the platform 16 was greater than the thickness of the columnar layer 26 on the airfoil 12. As a result, a sufficiently thick TBC (26 and 30) was deposited on the platform 16 to provide additional thermal protection to the platform 16.

Conventional wisdom in the art has been that thermal sprayed TBC's such as the noncolumnar layer 30 must be deposited on a thick, rough bond coat to promote adhesion. Surprisingly, the thermal-sprayed noncolumnar layer 30 of the TBC has been shown to adhere well to the as-deposited surface of the PVD-deposited columnar layer 26, even though the surface of the columnar layer 26 is quite smooth, e.g., about 40 to 60 micro-inches (about 1 to 1.5 micrometers) Ra and less.

In addition to blades, this invention can be advantageous for use with other components whose geometries result in uneven deposition by PVD, and/or have limited surface regions that would benefit from thicker TBC as a result of the particular service environments. For example, when depositing TBC by EBPVD on a gas turbine engine nozzle with one or more air-cooled airfoils held between inner and outer bands, the bands typically receive only a thin TBC. With the present invention, additional TBC can be selectively deposited on the inner and outer bands by thermal spraying. This invention can also be used to make locally thick coatings on airfoils in areas where closure of cooling holes is not a problem, such as the suction side of an HPT blade.

Figure 3:
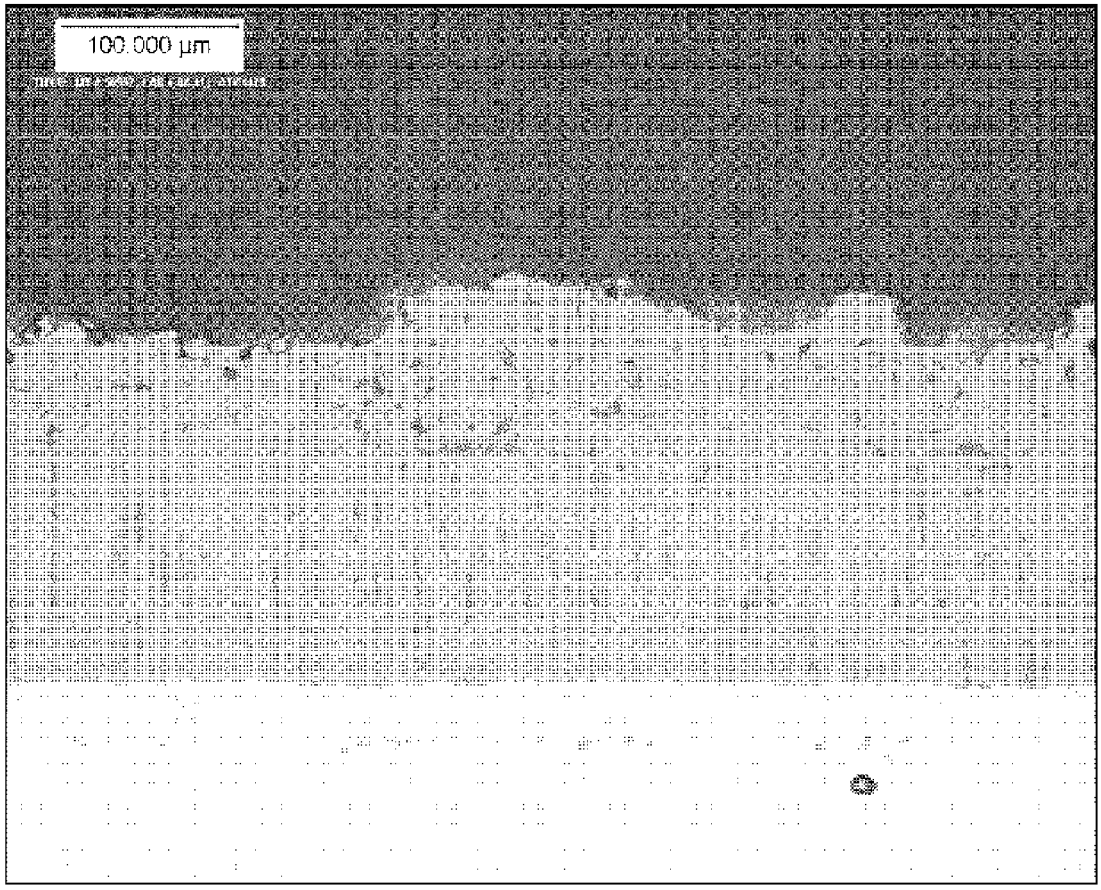
FIG. 3 is a scanned image of a multilayer TBC system deposited in accordance with the invention.

In an investigation leading to this invention, four button specimens were prepared of René N5 single-crystal superalloy, on which a standard PtAl diffusion bond coat was deposited. Thereafter, an EBPVD TBC of YSZ was deposited to a thickness of about five mils (about 125 micrometers), followed by a plasma-sprayed TBC of YSZ having a thickness of about five mils (about 125 micrometers). A specimen produced by this coating process is shown in FIG. 3. The buttons underwent thermal cycle testing with one-hour cycles between room temperature and about 2075° F. (about 1135° C.), with a dwell time of about forty-five minutes at peak temperature. A total of over 200 cycles was completed without a spallation event.

Two additional N5 buttons were prepared in the same manner for tensile bond testing to evaluate the strength of the bond between the EBPVD TBC and the plasma-sprayed TBC. The coating systems on the buttons fractured at the interface between the plasma-sprayed TBC and the EBPVD TBC at maximum stress levels of about 1375 and 1390 psi (about 9.5 and 9.6 MPa, respectively), which is equivalent to bond strengths typically exhibited by plasma-sprayed TBC' deposited on MCrAlX overlay bond coats.

While the invention has been described in terms of a preferred embodiment, it is apparent that other forms could be adopted by one skilled in the art. Therefore, the scope of the invention is to be limited only by the following claims.

What is claimed is:

1. A thermal barrier coating system on first and second surface portions of a component, the thermal barrier coating system comprising:

a first ceramic layer on the first and second surface portions of the component and having a columnar microstructure; and a second ceramic layer on the first ceramic layer present on the second surface portion of the component but not on the first ceramic layer present on the first surface portion of the component, the second ceramic layer having a microstructure characterized by irregular flattened grains;

wherein the first ceramic layer is thicker on the first surface portion than on the second surface portion of the component.

2. The thermal barrier coating system according to claim 1, wherein the component is a gas turbine engine component, and the first and second surface portions are an airfoil portion and a platform portion, respectively, of the component.

3. The thermal barrier coating system according to claim 1, wherein the first and second ceramic layers on the second surface portion have a combined thickness that is greater than the thickness of the first ceramic layer on the first surface portion.

4. The thermal barrier coating system according to claim 1, wherein the first and second ceramic layers contain the same base ceramic compound.

5. The thermal barrier coating system according to claim 1, wherein the first and second ceramic layers have the same chemical composition.

6. The thermal barrier coating system according to claim 1, wherein the first and second ceramic layers consist of zirconia, at least one stabilizer, and incidental impurities.

7. A thermal barrier coating system on first and second surface portions of a component, the thermal barrier coating system comprising:

a first ceramic layer on the first and second surface portions of the component and having a columnar microstructure; and a second ceramic layer on the first ceramic layer present on the second surface portion of the component but not on the first ceramic layer present on the first surface portion of the component, the second ceramic layer having a microstructure characterized by irregular flattened grains;

wherein the component is a gas turbine engine component, and the first and second surface portions are an airfoil portion and a platform portion, respectively, of the component.

8. The thermal barrier coating system according to claim 7, wherein the first ceramic layer is thicker on the airfoil portion than on the platform portion, and the first and second ceramic layers on the platform portion have a combined thickness that is greater than the thickness of the first ceramic layer on the airfoil portion.

9. A thermal barrier coating system on a surface of a component, the thermal barrier coating system comprising:

a first layer having a columnar microstructure and formed of a first ceramic material predominantly of a base ceramic compound; and a second layer on the first layer and formed of a second ceramic material predominantly of the base ceramic compound, the second layer having a microstructure characterized by irregular flattened grains;

wherein the first layer is present and the second layer is not present on a first region of the surface of the component, the first and second layers are present on a second region of the surface of the component, and the first layer is thicker on the first region than on the second region of the surface.

10. The thermal barrier coating system according to claim 9, wherein the component is a gas turbine engine component having an airfoil portion between inner and outer bands, the first region of the surface is on the airfoil portion, and the second region of the surface is on at least one of the inner and outer bands.

11. The thermal barrier coating system according to claim 10, wherein the first and second layers on the at least one of the inner and outer bands have a combined thickness that is greater than the thickness of the first layer on the airfoil portion.

12. The thermal barrier coating system according to claim 9, wherein the first and second layers on the second region have a combined thickness that is greater than the thickness of the first layer on the first region.

13. The thermal barrier coating system according to claim 9, wherein the first and second ceramic materials have the same chemical composition.

14. The thermal barrier coating system according to claim 9, wherein the base ceramic compound is zirconia.

15. The thermal barrier coating system according to claim 9, wherein the component is a gas turbine engine component having an airfoil portion and a platform portion, the first layer is present and the second layer is not present on the airfoil portion, the first and second layers are present on the platform portion, the first layer is thicker on the airfoil portion than on the platform portion of the component, and the first and second layers on the platform portion have a combined thickness that is greater than the thickness of the first layer on the airfoil portion.

* * * * *